United States Patent [19]

Hara et al.

[11] Patent Number: 4,557,247

[45] Date of Patent: Dec. 10, 1985

[54] WARM-AIR HEATING APPARATUS

[75] Inventors: Masanori Hara, Yokohama; Sakuo Sugawara; Kisuke Yamazaki, both of Kamakura; Hiroshi Kasagi, Chigasaki, all of Japan

[73] Assignee: Mitsubishi Denki Kabushiki Kaisha, Tokyo, Japan

[21] Appl. No.: 556,324

[22] Filed: Nov. 30, 1983

[30] Foreign Application Priority Data

Nov. 30, 1982 [JP] Japan ..... 57-209709
Nov. 30, 1982 [JP] Japan ..... 57-209711
May 30, 1983 [JP] Japan ..... 58-95221

[51] Int. Cl.[4] ..... F24F 7/06

[52] U.S. Cl. ..... 126/99 R; 98/33.1; 98/34.6; 126/110 E

[58] Field of Search ..... 126/110 B, 110 D, 110 E, 126/105 A, 108, 99 R, 80, 84, 116 R; 219/369, 370, 364; 237/46; 98/33 A, 33.1, 34.6; 110/185, 186, 190; 236/49

[56] References Cited

U.S. PATENT DOCUMENTS

| | | | |
|---|---|---|---|
| 2,131,725 | 10/1938 | Chester | 98/33 A |
| 2,313,676 | 3/1943 | Shaver | 98/33 A |
| 3,143,952 | 8/1964 | Simons | 98/33 A |
| 4,110,600 | 8/1978 | Spotts et al. | 219/364 |
| 4,134,545 | 1/1979 | Westbrook | 98/33 A |
| 4,136,606 | 1/1979 | Wolbrink | 98/33 A |
| 4,302,663 | 11/1981 | Chesnut | 219/369 |
| 4,350,085 | 9/1982 | Lis | 98/33 A |
| 4,411,252 | 10/1983 | Funkhouser | 126/80 |

FOREIGN PATENT DOCUMENTS

| | | | |
|---|---|---|---|
| 2495290 | 6/1982 | France | 126/110 E |
| 57-6244 | 1/1982 | Japan | 126/110 D |
| 152644 | 1/1982 | Japan . | |

OTHER PUBLICATIONS

Reito Kuhcho Gijutsu, vol. 33, No. 387, May, 1982, entitled "Environmental Improvement of Facilities Installed a Warm-Air Heating Apparatus".

*Primary Examiner*—Henry C. Yuen
*Attorney, Agent, or Firm*—Oblon, Fisher, Spivak, McClelland & Maier

[57] ABSTRACT

A warm-air heating apparatus has a warm-air blowing port 2 for blowing warm air which is warmed in a heat source 4 provided in a casing after having been sucked through an air intake port 3, and a non-warm-air blowing port 9 provided independent of the warm-air blowing port 2 in which a blower 5 or 11 is placed for each port 2 or 9 to feed warm air to the lower part of a room and to feed non-warm air to the upper part of the room respectively so as to wrap the warm air with the non-warm air whereby temperature distribution in the vertical direction in the room is improved. The warm-air heating apparatus keeps living space warm to create a comfortable heating condition for the room and reduces wasted energy having been consumed to warm the ceiling area of the room in the conventional apparatus thereby improve efficiency of the heating apparatus.

10 Claims, 11 Drawing Figures

FIGURE 1 *PRIOR ART*
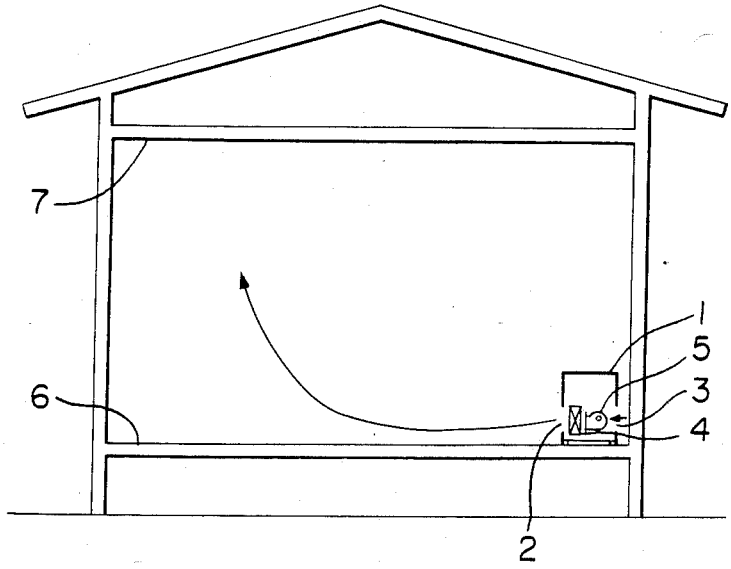
FIGURE 2
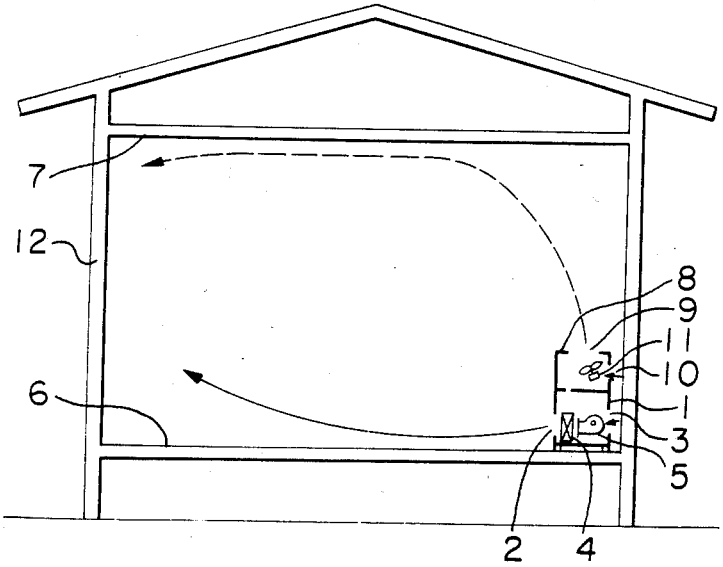

WARM-AIR HEATING APPARATUS

The present invention relates to a warm-air heating apparatus constructed in such a manner that air taken into an air intake port is warmed by a heat source provided in a casing and thus warmed air is blown from a warm-air blowing port to warm a room.

FIG. 1 is a schematic diagram of a conventional floor type warm-air heating apparatus. In FIG. 1, the reference numeral 1 designates a casing; 2 designates a warm-air blowing port formed at the lower part of the front surface of the casing; 3 designates a room-air intake port provided at the rear side of the casing 1 so as to be communicated with the blowing port 2; 4 designates a heat exchanger as a heat source for warming; 5 designates a blower for warm air which sucks air from the intake port 3 to feed it to the heat exchanger 4 and blows from the blowing port 2 the air warmed in the heat exchanger 4 downwardly and toward the front of the casing; 6 designates the floor of a room where the warm-air heating apparatus is installed; and 7 designates the ceiling of the room.

In the warm-air heating apparatus having the construction above-mentioned, when it is connected to a power source, the heat exchanger 4 and the blower 5 are actuated to blow warm air along the floor. However, the warm air flows as indicated by the arrow mark toward the ceiling 7 as a vacant area as the warm air goes away from the warm-air flowing port 2 because it has a low specific gravity. As a result, there results much disadvantageous temperature distribution from the economical viewpoint, in which temperature of the vicinity of the floor 6 for a living space is relatively low while the vicinity of the ceiling 7 is relatively high in temperature.

An attempt to improve such inadequate temperature distribution by directing warm air with a large angle so as to feed it to the floor 6 near the blowing port 2 has invited a separate drawback of deterioration of materials used for the floor. Also another attempt to improve the temperature distribution as above mentioned by directing the warm air at a high flow rate with a small angle with respect to the floor has caused uncomfortableness to a user because a warm-air stream blows against its body at the high flow rate.

It is an object of the present invention to overcome the disadvantage of the conventional apparatus from the viewpoint other than the attempts of improvement above-mentioned and to provide a warm-air heating apparatus able to equalize temperature distribution and to render heating conditions in a room to be comfortable, by installing, in addition to the structure of the conventional apparatus, a blower for non-warm air which feeds a stream of non-warm air toward the upper part of a room from a non-warm-air blowing port provided independent from a warm-air blowing port wherein the blower for non-warm air is actuated at least temporarily at the time of the actuation of a blower for warm air.

The foregoing and the other objects of the present invention have been attained by providing a warm-air heating apparatus which comprises a casing, a warm-air blowing port and a room-air intake port provided in the casing so as to be communicated with each other, a heat source placed between the warm-air blowing port and the room-air intake port, a blower for warm air which sucks air from the room-air intake port to feed it into the heat source for warming and blows the air warmed in the heat source in the front of the casing through the warm-air blowing port, and a blower for non-warm air for feeding a stream of non-warm air toward the upper part of a room from a non-warm-air blowing port provided independent from the warm-air blowing port wherein the blower for non-warm air is actuated at least temporarily at the time of the actuation of the blower for warm-air.

The warm-air heating apparatus of the present invention improves temperature distribution in the vertical direction in a room and is effective to give a comfortable heating condition in a room by providing a blower for warm air and a blower for non-warm air, the latter being actuated at least temporarily at the time of the actuation of the former.

Various other objects, features and attendant advantages of the present invention will be more fully appreciated as the same becomes better understood from the following detailed description when considered in connection with the accompanying drawings in which like reference numerals designate like or corresponding parts throughout the several views and wherein:

FIG. 1 is a schematic view of the conventional warm-air heating apparatus;

FIG. 2 is a schematic view of an embodiment of the warm-air heating apparatus of the present invention;

Figure 3:
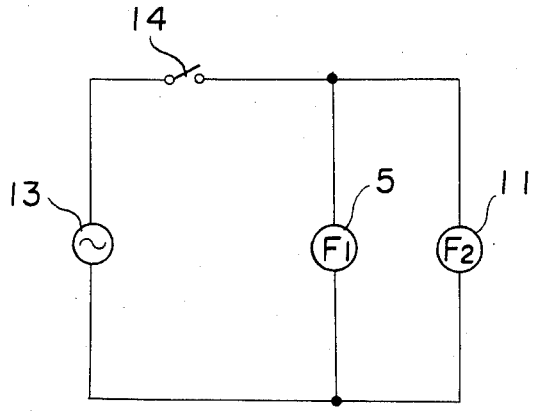
FIG. 3 is a circuit diagram of an embodiment of the apparatus shown in FIG. 2.

An embodiment of the present invention will be described with reference to FIG. 2 in which the reference numerals 1 to 7 designate the same or corresponding parts as described above. In FIG. 2, an upper casing 8 is provided on the casing 1 and a non-warm-air blowing port 9 opens in the upper surface of the upper casing 8. A room-air intake port for non-warm air 10 is formed in the rear side of the upper casing 8 so as to be communicated with the non-warm-air blowing port 9. A blower for non-warm air 11 is placed between the blowing port 9 and the intake port 10 to cause a stream of non-warm air as indicated by the broken arrow mark directing from the blowing port 9 into the upper part of a room. The reference numeral 12 designates a side wall facing the warm-air heating apparatus constructed as above-mentioned.

FIG. 3 is a circuit diagram showing how the blowers 5 and 11 are electrically connected. The blowers 5 and 11 are connected in parallel to a commercial power source through a power source switch 14.

In the warm-air heating apparatus, when the switch 14 is closed, the heat exchanger 4 and the blower 5 are actuated to blow warm air forwardly and downwardly through the blowing port 2 as shown by the solid arrow mark in FIG. 2. On the other hand, the blower 11 is simultaneously started to form a stream of non-warm air as shown by the broken arrow mark directing from the blowing port 9 toward the ceiling 7. Since the specific gravity of the non-warm air is greater than that of the warm air, the non-warm-air stream, as a whole, falls as well as a part of the stream striking the side wall 12 so that the non-warm air wraps the warm air. The warm air is, therefore, prevented from going up and reaches the wall 12 even though the flow rate of the warm air is low. Further, since the non-warm air is mixed with the warm air, the temperature at the upper part of the room is reduced whereby temperature distribution in the room is remarkably improved in correlation of the effect above-mentioned.

Figure 4:
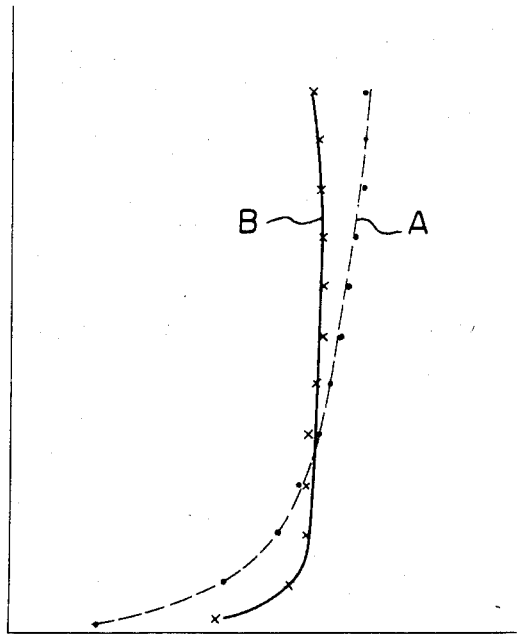
FIG. 4 is a graph showing the effect of the present invention.

FIG. 4 is a diagram showing effect of the warm-air heating apparatus wherein the curve A indicates temperature distribution obtained by the conventional apparatus and the curve B indicates temperature distribution attainable by the present invention. As apparent from the figure, the curve A represents that temperature is relatively low in the vicinity of the floor 6 or living space and is relatively high in the vicinity of the ceiling which is a non-living space. On the other hand, the curve B indicative of temperature distribution of the embodiment of the present invention represents that temperature distribution is substantially constant except for a small area near the floor 6. Namely, the warm-air heating apparatus of the present invention provides advantages such as not only that there is obtained a comfortable condition for a room with living space warmed by feeding warm air at a low flow rate but also that useless energy consumed to warm the vicinity of the ceiling 7 as in the conventional apparatus is greatly reduced thereby increasing operating efficiency of the heating apparatus.

In FIG. 3, there is shown that the blowers 5 and 11 are simultaneously actuated. However, it is possible to modify the circuit in such a way that an additional switch is connected to stop only the operation of the blower 11 so that the operation of the blower 11 is stopped when a user sits near the blowing port 2. This construction renders the heating apparatus to be convenient while a comfortable condition is given.

Figure 5:
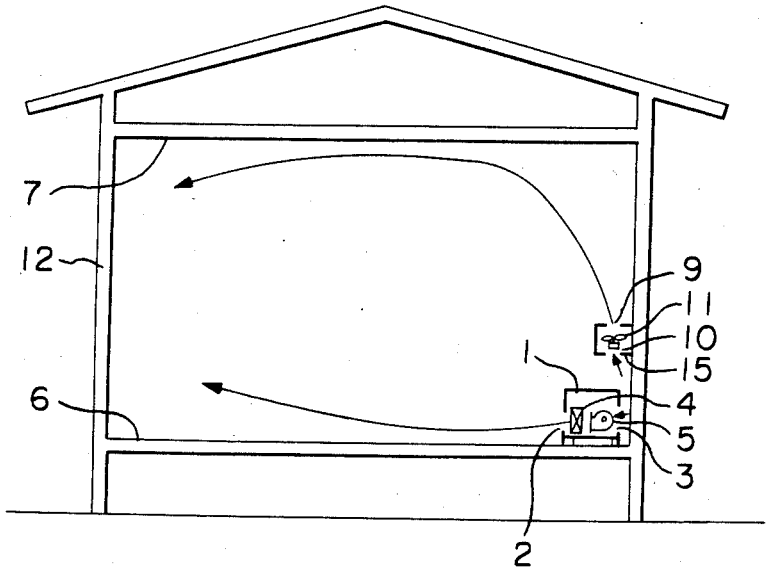
FIG. 5 is a schematic view of another embodiment of the warm-air heating apparatus of the present invention.

FIG. 5 is a schematic view of another embodiment of the present invention wherein like reference numerals as in FIG. 2 designate like or corresponding parts. The embodiment shown in FIG. 5 is the same as in FIG. 2 except that a non-warm-air blowing port 9 and a blower for non-warm-air 11 are provided in a casing for non-warm air 15 which is placed independent of the casing 1. The construction as above mentioned allows a user to buy the casing separately at his option and to use the casing 15 in combination of the conventional heating apparatus.

Further, when the casing 15 is properly installed above the casing 1, pressure loss of the stream of non-warm air due to the ceiling 7 can be small in comparison with the embodiment shown in FIG. 2, hence, the capacity of the blower 11 can be small. In this case, the non-warm air is prevented from entering into the living space.

In a mobile type heating apparatus such as a fan heater, separation of the casing 15 advantageously lightens the casing 1.

Further, in a fan heater type heating apparatus where air in a room is utilized for combustion, it is necessary to introduce fresh air into the room. The warm-air heating apparatus of this embodiment of the present invention can be modified in such a manner that a heat recovery type ventilating device which is so constructed that air discharged in a room is heat-exchanged with outdoor air introduced therein, is provided in the casing 15 whereby the room air is mixed with a small amount of the air introduced from the outdoors to use the mixed air as non-warm air. With this construction, temperature distribution in the room can be uniform and the room air can be kept in fresh condition.

The blower 11 may be intermittently operated during the operation of the blower 5 if much outdoor air is introduced. In this case, temperature distribution is considerably improved in comparison with the conventional apparatus because furniture, tools and so on in the room become warm.

Figure 6:
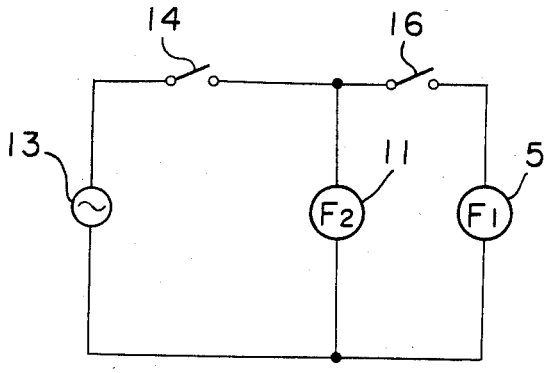
FIG. 6 is a circuit diagram of still another embodiment of the present invention.

FIG. 6 is a circuit diagram showing a separate embodiment of the present invention in which the construction of the heating apparatus is same as that of FIG. 2. In the figure, a thermostat 16 is interposed in the circuit to control operation and stoppage of the blower 5 dependent on temperature in a room. The serial connection of the thermostat 16 and the blower 5 is connected in parallel to the blower 11, which is, in turn connected to a power source 13 through a switch 14.

In the construction of the warm-air heating apparatus above-mentioned, when room temperature decreases to a preset temperature for starting warming operation, the blower 5 is actuated to feed warm air from the blowing port 2. When the room temperature increases to a preset temperature for stopping the warming operation, the contact of the thermostat 16 is opened to stop the blower 5, hence feeding of the warm air is stopped. Thus, warming operation is carried out by repeating such on-off operations of the blower 5. On the other hand, the blower 11 continues to operate while the switch 14 opens.

When the blowers 5 and 11 operate simultaneously, the condition is the same as those in FIGS. 2 and 3 and accordingly, temperature distribution in the room becomes uniform. In case that the blower 5 is stopped while the blower 11 runs, the time required for the temperature in the living space decrease to a preset level is delayed because the non-warm air prevents the warm air from going up to thereby save energy. In this case, however, it is desired to weaken the flow rate of the non-warm air to be lower than that of the warm air.

A construction modified from the embodiment above-mentioned in such a way that the heat sensitive part of the thermostat 16 is placed near the intake port 3 and the separate intake port 10 is formed near the heat sensitive part, provides a further remarkable effect. Generally, the heating apparatus having the construction as above-mentioned detects correctly and without delay a preset temperature for stopping warming operation by the heat sensitive part of the thermostat 16 because the blower is actuated and there is a flow of room air around the heat sensitive part. However, when a preset temperature for starting warming operation is to be detected, if there is provided no blower 11 as the conventional apparatus does, air in the vicinity of the heat sensitive part is stagnant because of stoppage of the blower 5, while residual heat is present in the casing 15 whereby response for detection tends to be delayed and the range of variation in room temperature becomes large. The warming condition above-mentioned is apparently undesirable to warm a room. In the embodiment of the present invention, however, even when a preset temperature for starting warming operation is to be detected, air around the heat sensitive part is influenced by the actuation of the blower 11 to thereby obtain correct detection of the preset temperature without delay of time. Accordingly, variation in the range of room temperature is made small to impart a comfortable warming operation.

Figure 7:
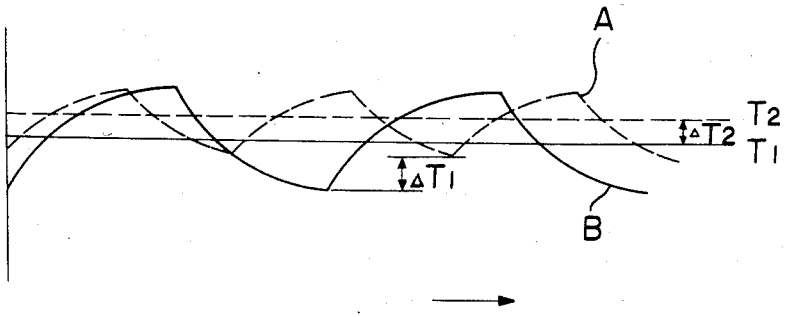
FIG. 7 is a diagram showing variation in room temperature at the time of ON-OFF of a thermostat.

That is, as shown by the curve A in FIG. 7, the change of room temperature is smaller than that of the conventional apparatus (the curve B in FIG. 7); temperatue in average rises by $\Delta T_2$ and the lowest temperature in the average temperature in a room rises by $\Delta T_1$. A comfortable warming condition is, therefore, obtainable by reducing the preset temperature of the thermostat 16 by 1° C. at the time of blowing non-warm air from the blowing port 9. Thus, good warming conditiion can be created even though the preset temperature is reduced by 1° C. and also energy saving is possible. In order to attain such effect, it is unnecessary to always actuate the blower 11 during the stoppage of the blower 5 and it is enough to actuate it when room temperature decreases to near the preset temperature for starting warming operation. For this purpose, the blower 11 may be actuated at a predetermined time after the stoppage of the blower 5. Further, to eliminate feeling of coolness which a user may have during the actuation of the blower 11 at the initial stage of warming operation, the blower 11 may be actuated at a predetermined time after the switch 14 is closed or the blower may be started or stopped by a manually operated switch according to a user's choice.

Figure 8:
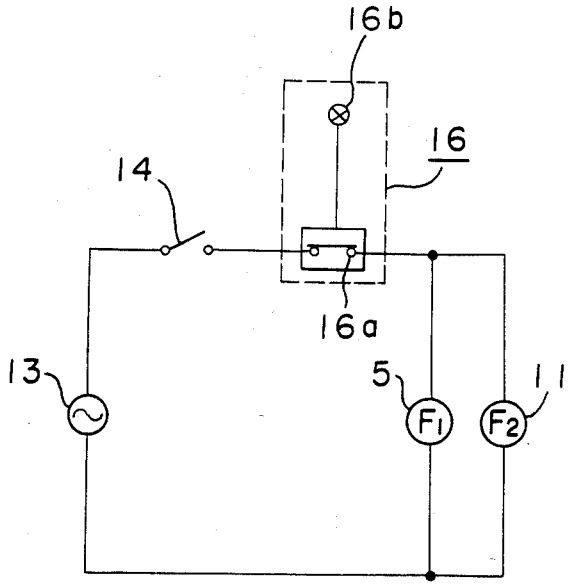
FIG. 8 is a circuit diagram of a separate embodiment of the present invention.

FIG. 8 is a simplified circuit diagram showing a control system of another embodiment of the present invention. A thermostat 16 is connected to a commercial power source 13 through a power source switch 14. The thermostat 16 has a contact **16*a* at its load side which is connected to a terminal of the parallel connection of blowers 5 and 11. The reference numeral 16*b*** designates a heat sensitive part.

The blower 5 of the warm-air heating apparatus constructed as above-mentioned undergoes control of actuation and stoppage by the thermostat 16 with respect to temperature in a room. In this embodiment, the blower 11 is operated in synchronism with the blower 5 in the warming operation since the blower 11 is connected the contact **16*a* in parallel to the blower 5**.

Further, a user does not feel coolness due to non-warm air since the blowers 5 and 11 are stopped synchronously at the time of stoppage of warming operation.

The control of the blowers 5 and 11 by the single thermostat 16 makes the construction of the apparatus simple; provides high rilability and reduce manufacturing cost.

The description has been made as to the blower 5 which is continuously operated or is subjected to conrol of actuation and stoppage. The effect for imparting uniform temperature distribution in a room can be attained by controllig the air flow rate of the blower 5 through an inverter such as FRK-400 inverter manufactured by Mitsubishi Denki Kabushiki Kaisha in which output frequency is variable dependent on room temperature, in association with the blower 11.

It is possible that an inverter operating in response to the inverter for the blower 5 is provided in the blower 11 to control the air flow rate and that the blowers 5 and 11 are respectively subjected to manual control for strengthening and weakening air flow. In these case, a desired warming mode can be obtained by a combination of the air flow rates of both the blowers in such a manner that, for example, good warming condition is given in an area near the heating apparatus by weakening air-flow blown from both the blowers 5 and 11 or good warming condition is given in an area near the side wall 12 by strengthening air-flow blown from both the blowers.

In the foregoing, even though the description has been made as to a floor type warm-air heating apparatus, the same effect can be attained with a wall type, window type, or ceiling type heating apparatus and so on, as far as these apparatus have the same structure as in the embodiments of the present invention.

In the embodiment, non-warm-air blowing port 9 is formed in the upper surface of the casing 8 or 15. It is not critical. It may be formed a desired portion unless warm air is crossed to non-warm air and the non-warm air substantially enters into a living space.

Figure 9:
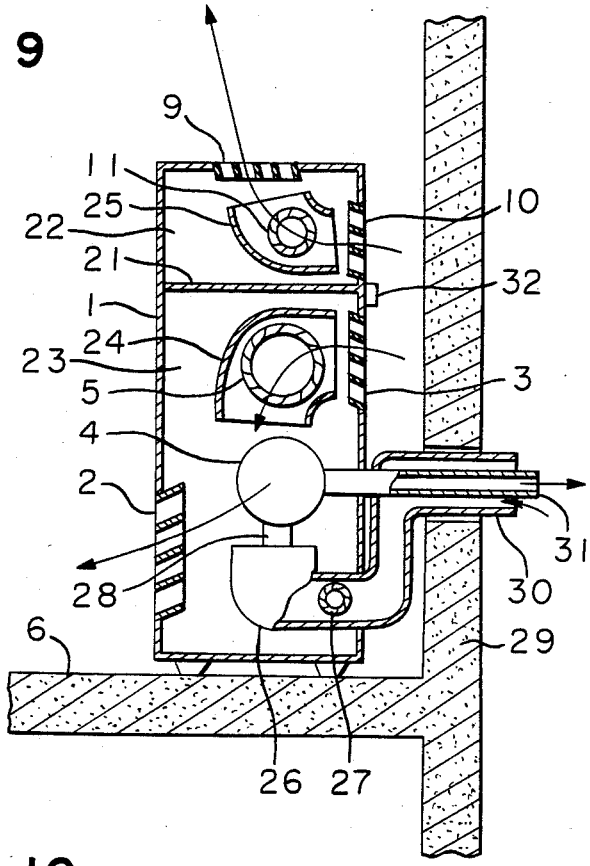
FIG. 9 is a longitudinal cross-section view, partly omitted, of another embodiment of the present invention.
Figure 10:
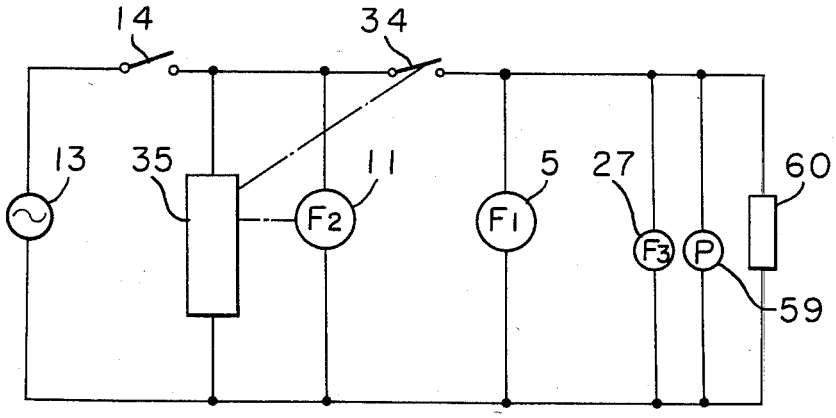
FIG. 10 is a diagram showing a basic circuit of the embodiment as shown in FIG. 9.
Figure 11:
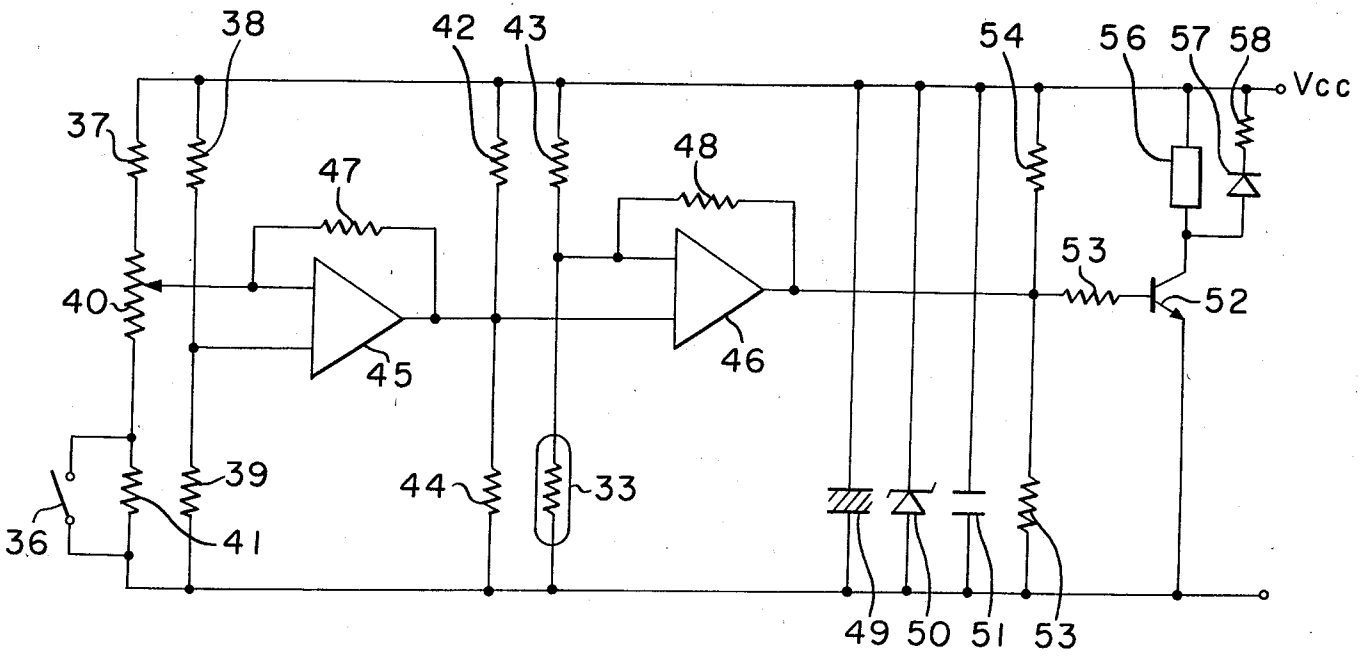
FIG. 11 is a diagram of the control circuit of the embodiment as shown in FIG. 10.

FIGS. 9 to 11 show still another preferable embodiment of the present invention.

In FIG. 9, a casing 1 is provided with a warm-air blowing port 2 having an opening directing downwardly and in the front of the casing and a non-warm-air blowing port 9 formed at the central portion of the top surface of the casing. A transverse partition plate 21 defines the casing 1 into an upper section 22 as a first chamber and a lower section 23 as a second chamber. A room-air intake port 3 is formed at the rear side of the casing 1 so as to communicate the second chamber 23 with the room interior. A heat exchanger 4 is laterally held in the second chamber 23 of the casing and is positioned near the blowing port 2. A cross-flow type blower for warm air 5 is placed above the heat exchanger 4 and adjacent the room-air intake port 3 to feed air sucked through the intake port 3 around the heat exchanger. A blower guide 24 having one opening facing the intake port and the other opening facing the heat exchanger containes the blower 5 to feed air effectively. A room-air intake port for non-warm air 10 is formed at the upper rear side of the casing to communicate the first chamber 1 with the room interior. A cross-flow type blower for non-warm air 11 is placed in the first chamber 1 to feed air sucked through the intake port 10 to the non-warm-air blowing port 9. A blower guide 25 is provided to contain the blower 11 and to direct air from the intake port 10 to the blowing port 9.

A cylindrical, oil or gas combustion burner 26 is placed below the heat exchanger 4 and is connected with one end of a suction pipe 30 the other end of which extends through the wall 29 of a building. A blower for combustion 27 is housed in the suction pipe 30 which feeds fresh air to the burner 26 and further feeds gas highly elevated in temperature by combustion to the heat exchanger 4 through a connecting pipe 28. A discharge pipe 31 is connected to the heat exchanger 4 and extends through the inner part of the discharge pipe 30 to open to the outside whereby the discharge gas from the heat exchanger 4 is evacuated.

A heat sensitive part 32, which corresponds to the heat sensitive part **16*a* in the embodiment as shown in FIG. 8, includes a thermistor 33 having a positive characteristic as a heat sensitive element, the heat sensitive part being attached intermediate of the intake ports 3 and 10 at the rear side of the casing 1**.

The circuit structure of the embodiment as above-mentioned will be described with reference to FIG. 10 as a basic circuit.

In FIG. 10, the reference numeral 13 designates a commercial power source; 14 designates a power source switch; 5 and 11 respectively designate blowers as explained with FIG. 9; 34 designates the contact of a relay connected in series to the blower 5. A control circuit 35 for controlling the relay connected in parallel to the blowers 5 and 11, is constructed in such a manner of actuating at a preset temperature for starting contact 34 warming operation to close the contact 34, similar to the thermostat 16 explained with respect to the embodiments of FIGS. 6 and 8. The control circuit 35 includes a temperature control circuit, as shown in FIG. 11, which is connected to the commercial power source 13 through a rectifier circuit (not shown).

In FIG. 11, the reference numeral 36 designates an operation detecting switch which is closed in response to the operation of the blower for non-warm air 11; 37, 38 and 39 respectively designate shunt resistors and 40 designates a variable resistor capable of presetting a warming operation initiating temperature.

In the circuit having the above construction, when a warming operation initiating temperature is set by adjusting the variable resistor 40 and the power source switch 14 is closed, a fuel feeder 59 is actuated to supply gas or oil to the combustion burner 26 and at the same time, the blower 27 supplies air for combustion and then the burner 26 is fired by an ignition circuit 60.

On the other hand, the blower for warm air 5 and the blower for non-warm air 11 are simultaneously actuated so that a part of room air warmed by the heat exchanger 4 is blown from the warm-air blowing port 2 and a part of room air is directly blown from the non-warm-air blowing port 9. Since the operation detecting switch 36 is automatically closed in response to the operation of the blower for non-warm air 11, the preset temperature for warming operation, namely the warming operation initiating temperature determined by the variable resistor 40 changes for a value given by the resistor with the consequence that the resistance of the resistor 41 automatically reduces the preset temperature for warming operation by 1° C.

Thus, by automatically reducing a preset temperature in the temperature control circuit by 1° C. during the operation of the blower for non-warm air 11, good warming condition as well as energy saving can be attained as similar to the embodiment of FIG. 7.

We claim:

1. A warm-air heating apparatus comprising:

a casing, a warm-air blowing port on a front of said casing, said warm-air blowing port and a room-air intake port provided in the casing so as to be in communication with each other, a heat source placed in said casing between the warm-air blowing port and the room-air intake port, a blower in said casing for warm air, said blower being positioned to suck air from the room-air intake port and to blow said air into the heat source and through the warm-air blowing port, said blower and warm-air blowing port being arranged to blow warm air toward a lower part of a room within which said apparatus is positioned, a non-warm air blowing port independent of said warm-air blowing port, and a second blower for non-warm air, said second blower and non-warm air blowing port being arranged above said first blower and in a common casing with said first blower for feeding a stream of non-warm air above said flow of warm air and toward an upper part of said room from said non-warm air blowing port, and means for controlling said blower and second blower such that the second blower for non-warm air is actuated at least temporarily during the time of the actuation of the blower for warm air.

2. A warm-air heating apparatus according to claim 1 including means for controlling said blower for warm air depending on room temperature and means not responsive to said means for controlling said blower for warm air for operating said blower for non-warm-air.

3. A warm-air heating apparatus according to claim 1 including a manually operated switch for operating and stopping said blower for non-warm air.

4. A warm-air heating apparatus according to claim 1 including means for controlling said blower for warm air depending on room temperature and means for operating said blower for non-warm air in synchronism with the operation of said blower for warm air.

5. A warm-air heating apparatus according to claim 1 wherein said blower for warm air includes an air flow rate controlling device.

6. A warm-air heating apparatus according to claim 1 wherein said second blower for non-warm air includes an air flow rate controlling device.

7. A warm-air heating apparatus according to claim 1 including a room temperature control device to control the operation and stoppage of said blower for warm air.

8. The apparatus of claim 1 wherein said warm air blowing port includes means for directing air in a downward direction and said non-warm air blowing port includes means for blowing air in an upward direction.

9. A warm-air heating apparatus comprising:

a casing, a warm-air blowing port on a front of said casing, said warm-air blowing port and a room-air intake port provided in the casing so as to be in communication with each other, a heat source placed in said casing between the warm-air blowing port and the room-air intake port, a blower in said casing for warm air, said blower being positioned to suck air from the room-air intake port and to blow said air into the heat source and through the warm-air blowing port, said blower and warm-air blowing port being arranged to blow warm air toward a lower part of a room within which said apparatus is positioned, a non-warm air blowing port independent of said warm-air blowing port; and a second blower for non-warm air, said second blower and non-warm air blowing port being arranged for feeding a stream of non-warm air above said flow of warm air and toward an upper part of said room from said non-warm air blowing port, means for controlling said blower and second blower such that the second blower for non-warm air is actuated at least temporarily during the time of the actuation of the blower for warm air;

a room temperature control device to control the operation and stoppage of said blower for warm air including a heat sensitive part of said temperature control device placed near said room-air intake port.

10. A warm-air heating apparatus according to claim 9 including a second intake port for said second blower, wherein said room-air intake port for said blower for warm air and said room-air intake port for said second blower are respectively formed in a common side surface of said casing and said heat sensitive part of said temperature control device is attached intermediate of said intake ports.

* * * * *